US007973663B2

(12) United States Patent
Hall

(10) Patent No.: US 7,973,663 B2
(45) Date of Patent: Jul. 5, 2011

(54) ELECTRONIC ARTICLE SURVEILLANCE DEACTIVATOR USING VISUAL PATTERN RECOGNITION SYSTEM FOR TRIGGERING

(75) Inventor: Stewart E. Hall, Wellington, FL (US)

(73) Assignee: Sensomatic Electronics, LLC, Boca Raton, FL (US)

( * ) Notice: Subject to any disclaimer, the term of this patent is extended or adjusted under 35 U.S.C. 154(b) by 424 days.

(21) Appl. No.: 12/349,889

(22) Filed: Jan. 7, 2009

(65) Prior Publication Data

US 2010/0171619 A1 Jul. 8, 2010

(51) Int. Cl.
*G08B 13/14* (2006.01)

(52) U.S. Cl. ..... 340/572.3; 340/572.4; 340/572.7; 340/10.1; 340/10.52; 340/573.1; 340/573.4; 340/521; 340/540; 382/103; 382/104; 382/181; 235/462.41; 235/462.42; 235/454; 235/492

(58) Field of Classification Search ..... 340/572.3, 340/572.4, 572.7, 10.1, 10.52, 573.1, 573.4, 340/521, 540; 382/103, 104, 181; 235/462.41, 235/462.42, 454, 492
See application file for complete search history.

(56) References Cited

U.S. PATENT DOCUMENTS

| | | | | |
|---|---|---|---|---|
| 7,516,898 | B2 * | 4/2009 | Knowles et al. | 235/462.42 |
| 2004/0113791 | A1 | 6/2004 | Salim et al. | |
| 2009/0039165 | A1 * | 2/2009 | Collins et al. | 235/462.41 |

FOREIGN PATENT DOCUMENTS

| | | | |
|---|---|---|---|
| EP | 1306821 | A2 | 5/2003 |
| EP | 1890272 | A2 | 2/2008 |

OTHER PUBLICATIONS

International Search Report and Written Opinion dated Apr. 15, 2010 for International Application No. PCT/US10/000022, International Filing Date: Jan. 6, 2010 consisting of 9-pages.

* cited by examiner

*Primary Examiner* — Tai T Nguyen
(74) *Attorney, Agent, or Firm* — Alan M. Weisberg; Christopher & Weisberg, P.A.

(57) ABSTRACT

A method, system and electronic article surveillance tag deactivator detect the presence of an electronic article surveillance tag within a deactivation zone. Video of an item within the deactivation zone is captured. The video is evaluated using a pattern recognition technique to determine the presence of an electronic article surveillance tag within the deactivation zone. The electronic article surveillance tag is deactivated.

20 Claims, 3 Drawing Sheets

ELECTRONIC ARTICLE SURVEILLANCE DEACTIVATOR USING VISUAL PATTERN RECOGNITION SYSTEM FOR TRIGGERING

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to a method and system for deactivating Electronic Article Surveillance ("EAS") tags and more specifically to a method and system for deactivating EAS tags using a visual pattern recognition system for triggering.

BACKGROUND OF THE INVENTION

Recent advances in automatic article identification technology provide retail and wholesale sales facilities with an improved means for detecting when an article is being shoplifted. One such method, Electronic Article Surveillance ("EAS"), typically includes an EAS detector and EAS devices commonly called labels, tags. markers or transponders. The EAS detector transmits a radio-frequency ("RF") carrier signal to any EAS device within a certain range of the detector. An active EAS device responds to the carrier signal by generating a response signal of a predetermined frequency, which triggers an alarm when received at the detector. For example, an active magneto-acoustic EAS tag resonates at a predetermined frequency when stimulated by an interrogation signal. When a customer purchases an item that is protected by an active EAS tag, a cashier typically deactivates the tag using a deactivator that produces a magnetic deactivation field that alters the resonant frequency characteristic of the tag so that it no longer resonates at the predetermined frequency. The item may then be removed from the store without triggering an alarm.

Current EAS deactivation systems require an enabling signal to trigger the deactivation sequence. Presently, the primary method used to trigger the deactivation sequence involves the use of an interrogation field. The interrogation field is typically a radio-frequency magnetic field used to detect the presence of an EAS tag. When an EAS tag enters the interrogation field, the magnetic field induces a frequency response signal, or "EAS marker signal," for circuitry located within the EAS tag. Frequency detectors detect response signals having a resonant frequency within a predetermined range. When the amplitude of the EAS tag response signal is greater than a predetermined threshold, the EAS deactivation sequence is triggered.

In addition to detecting the mere presence of the EAS tag, the deactivator must also know the orientation of the EAS tag in order to assure proper deactivation. In some deactivators, up to three different magnetic fields are employed in the interrogation zone. Each magnetic field is oriented orthogonally to the other fields in order to ensure that the EAS tag signal is detected and to determine its orientation. Additional circuitry may compare the amplitude of the EAS signal detected in response to each field to determine which field is strongest. The coil producing the strongest response is "fired" to deactivate the EAS tag.

The use of an interrogation field to detect EAS tags has several problems. Because the EAS response signal can vary significantly from label to label, it is difficult to determine exactly what the predetermined threshold for triggering the EAS deactivation sequence should be. This variance can cause the deactivation sequence to be triggered when the tag is not in the correct location, thereby causing failures to deactivate ("FTDs").

Additionally, creating and detecting the magnetic field inside the interrogation area is very expensive, as at least one receiver and one magnetic field generator are required per deactivator. Also, certain materials may not be suitable for constructing antennas that operate at high frequencies, e.g., laminated, silicon steel does not operate well above about 1 or 2 kHz, requiring the use of more expensive materials for the antenna composition. Thus, the EAS tag detection circuitry alone can potentially add up to about 25% of the total cost of the deactivator.

Also, the EAS marker signal provides little certainty as to the orientation of the EAS tag. All that is really known is which coil produces the strongest response. This inaccuracy further contributes to additional problems with FTDs. Therefore, what is needed is a system, method and EAS tag deactivator for detecting EAS tags without the use of a traditional interrogation field.

SUMMARY OF THE INVENTION

The present invention advantageously provides a method and system for detecting the presence of an electronic article surveillance tag with a deactivation zone without requiring the use of a traditional magnetic field detector. Generally, the present invention uses pattern recognition techniques to detect the presence of an item in the deactivation zone of an EAS deactivator prior to deactivating the item's EAS tag.

In accordance with one aspect of the present invention, a method is provided for detecting the presence of an electronic article surveillance tag within a deactivation zone. Video of an item within the deactivation zone is captured. The video is evaluated using a pattern recognition technique to determine the presence of an electronic article surveillance tag within the deactivation zone. The electronic article surveillance tag is deactivated.

In accordance with another aspect of the present invention, an electronic article surveillance tag deactivator includes a deactivation zone, a video sensor, a video pattern recognition system, and a system controller. The video sensor operates to capture video of an item within the deactivation zone. The video pattern recognition system is communicatively coupled to the video sensor. The video pattern recognition system operates to evaluate the video using a pattern recognition technique to determine the presence of an electronic article surveillance tag within the deactivation zone. The system controller is communicatively coupled to the video pattern recognition system. The system controller operates to trigger deactivation of the electronic article surveillance tag in response to determining that the electronic article surveillance tag is within the deactivation zone.

In accordance with yet another aspect of the present invention, an electronic article surveillance deactivation system includes an electronic article surveillance tag deactivator having a deactivation zone, a video sensor, a video pattern recognition system, a system controller, and a deactivation trigger. The video sensor operates to capture video of an item within the deactivation zone. The video pattern recognition system is communicatively coupled to the video sensor. The video pattern recognition system operates to use a pattern recognition technique to determine the presence of an electronic article surveillance tag within the deactivation zone. The system controller is communicatively coupled to the video pattern recognition system. The system controller operates to trigger deactivation of the electronic article surveillance tag in response to determining that the electronic article surveillance tag is within the deactivation zone. The deactivation trigger is communicatively coupled to the system controller. The deactivation trigger operates to deactivate the electronic article surveillance tag.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
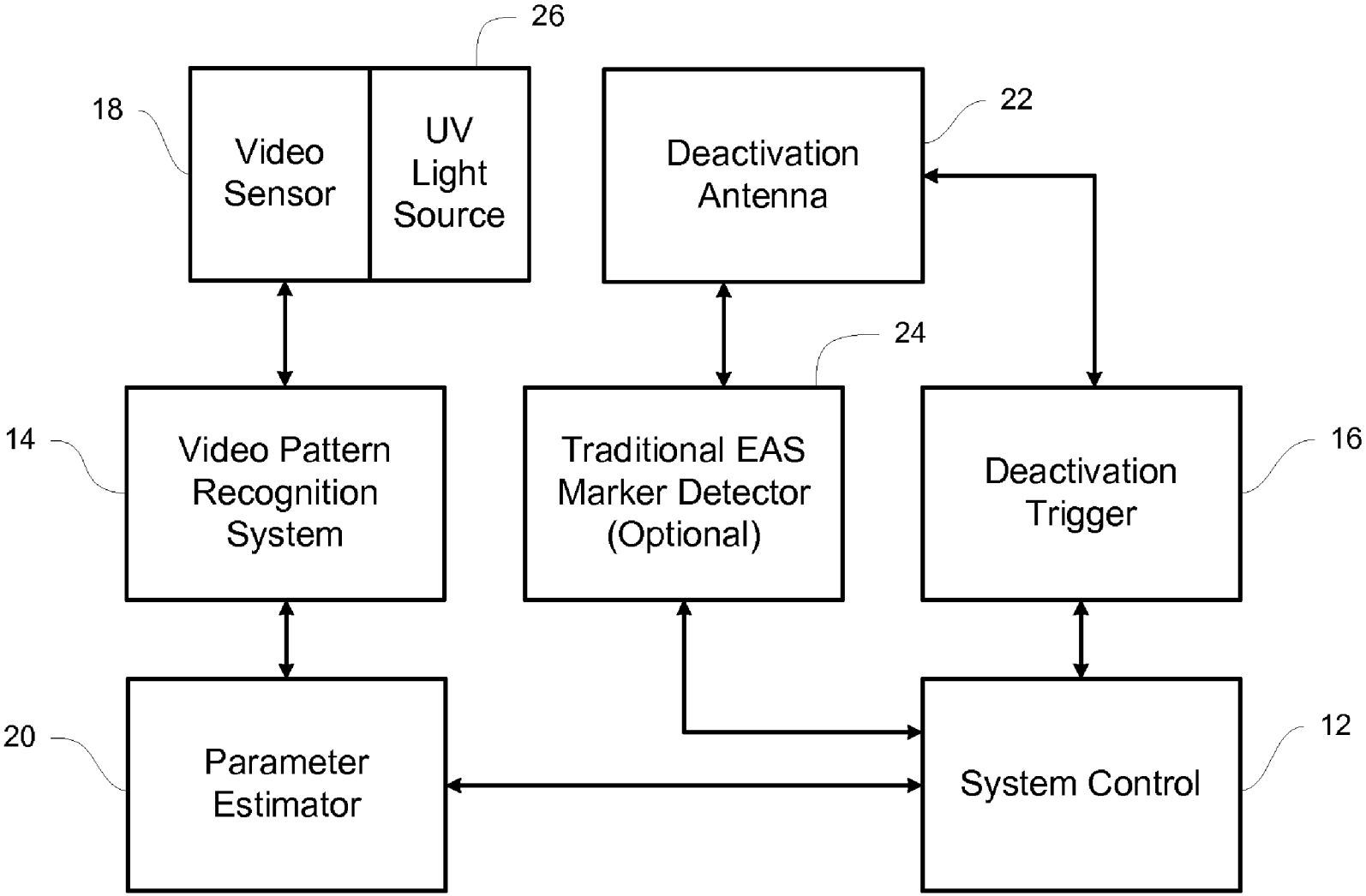
FIG. 1 is a block diagram of an exemplary electronic article surveillance deactivation system constructed in accordance with the principles of the present invention.

Before describing in detail exemplary embodiments that are in accordance with the present invention, it is noted that the embodiments reside primarily in combinations of apparatus components and processing steps related to implementing a system and method for triggering Electronic Article Surveillance ("EAS") tag deactivation using visual pattern recognition. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. Additionally, the terms "EAS tag," "EAS label," "EAS marker" and "EAS transponder" are used interchangeably herein.

One embodiment of the present invention advantageously provides a method and system for detecting and verifying the presence of an EAS tag or EAS marker using visual pattern recognition. Detection may be based on recognition of the shape or markings on the EAS marker or based on the presence of a bar code or other unique marking that is on the packaging near the EAS marker. The location and distance of the marker may be measured using stereo or focus based methods to verify that the marker is within the deactivation zone. This detection triggers the deactivation sequence.

In another embodiment of the invention, the visual detection system may be used to determine the orientation of the EAS marker. This orientation information can be used by the deactivator to determine the optimal timing and orientation of the deactivation field.

In yet another embodiment of the invention, the video pattern recognition system may be used in conjunction with a traditional EAS marker detection system to provide an improved system that uses both the EAS label amplitude information and the visual marker position, orientation and velocity information to optimally time the triggering of the deactivation sequence and the orientation of the deactivation field.

Referring now to the drawing figures in which like reference designators refer to like elements, there is shown in FIG. 1, an exemplary electronic article surveillance ("EAS") tag deactivation system 10 for detecting and deactivating EAS tags, constructed in accordance with the principles of the present invention. System 10 may include a system controller 12 communicatively coupled to a video pattern recognition system 14 and a deactivation trigger 16. The video pattern recognition system 14 receives video information from a video sensor 18 that captures video information of items within a deactivation zone. When the video pattern recognition system 14 determines that an EAS tag is within the deactivation zone, relevant information is sent to a parameter estimator 20 to calculate applicable parameters of the EAS tag. For example, parameters may include the EAS tag or other marker position, orientation, and velocity. Note that the parameter estimator 20 may be a stand-alone device or embedded within the video pattern recognition system 14 as an integrated function.

A detection indicator and associated parameters are sent to the system controller 12 which instructs the deactivation trigger 16 to send a deactivation signal to the EAS tag through the use of a deactivation antenna 22. The parameters are used to determine the timing of the deactivation sequence and the orientation of the deactivation antenna 22 when producing a deactivation field.

Additionally, the deactivation system 10 may optionally employ a traditional EAS marker detector 24, e.g., a magnetic field interrogation zone, in combination with the video pattern recognition system 14 to more accurately determine the presence and actual orientation of the EAS tag, thereby reducing the number of failures to deactivate. The deactivation system 10 may also include an optional ultraviolet ("UV") light source 26 to expose ultraviolet markings.

Figure 2:
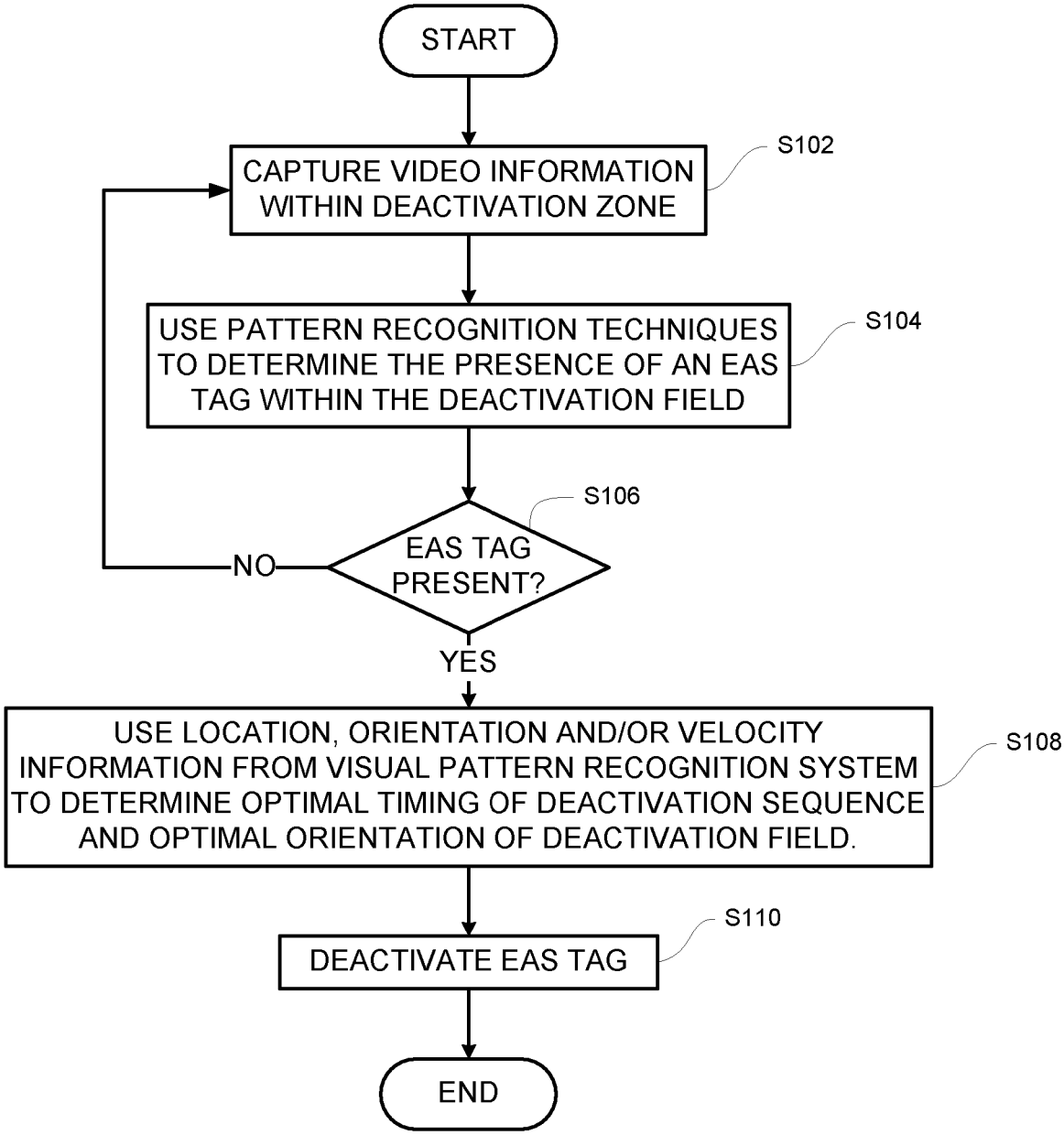
FIG. 2 is a flow chart of an exemplary electronic article surveillance detection and deactivation process according to the principles of the present invention.

Referring now to FIG. 2, an exemplary operational flowchart is provided that describes steps performed by an EAS tag deactivator 12 for detecting and deactivating an EAS tag within a deactivation zone, in accordance with the principles of the present invention. A video sensor 18 captures video information within the deactivation zone (step S102). A video pattern recognition system 14 uses known pattern recognition techniques to determine the presence of an EAS tag within the deactivation zone (step S104), e.g., the video pattern recognition system 14 may be programmed to recognize the shape of an EAS tag.

Figure 3:
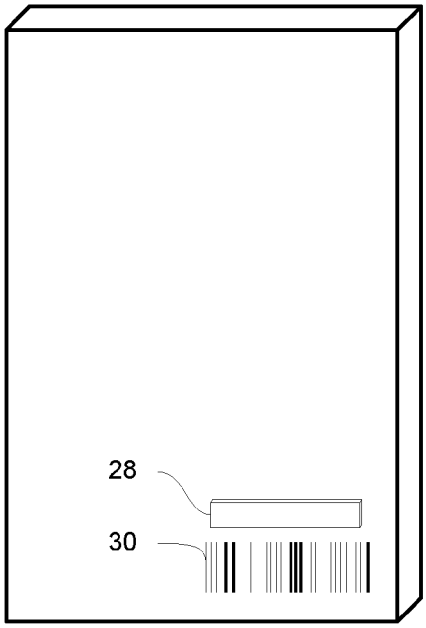
FIG. 3 is a diagram of an exemplary EAS tag location and bar code package marking in accordance with the principles of the present invention.
Figure 4:
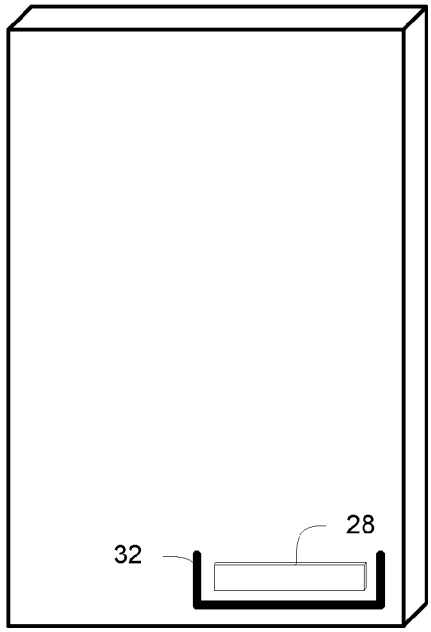
FIG. 4 is a diagram of an exemplary EAS tag location and package marking in accordance with the principles of the present invention.
Figure 5:
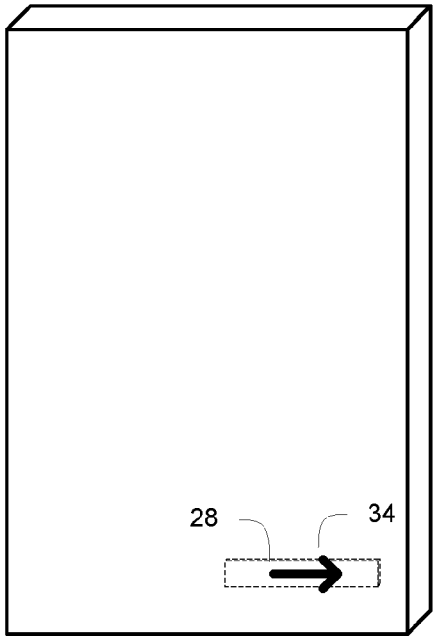
FIG. 5 is a diagram of an exemplary EAS tag location and package orientation marking in accordance with the principles of the present invention.

FIGS. 3-5 illustrate exemplary markers and marker placement in accordance with the principles of the present invention. As shown in FIG. 3, the video pattern recognition system 14 may alternatively determine the presence of an EAS tag 28 by detecting the presence of a barcode 30, as common practice within the retail industry is to place EAS tags or labels near the Universal Product Code ("UPC") barcode 30. The orientation of the bar code can be used to establish the orientation of the EAS tag 28 in the case where the EAS tag 28 is located inside the packaging. Implementation of the present invention may dictate that all EAS tags or labels 28 be placed in a designated location near the barcode 30. As shown in FIG. 4, it is also contemplated that a unique package marking 32 may be applied during source tagging to more precisely define the location and orientation of the EAS label 28 and source tagging applications. For example, as shown in FIG. 5, an arrow 34 or other marking used to denote orientation may be applied to product packaging at the location of the EAS tag or label. The marking may be on the outside of the packaging, directly above, or a pre-determined distance from an EAS label attached to the inside of the packaging. Additional embodiments may include the use of ultraviolet ("UV") ink to create the marking. The UV ink is not visible to the human eye and requires UV light to be detected by the video pattern recognition system 14. In this case, the deactivation system 10 may also include a UV light source to illuminate the ink and allow detection.

Referring again to FIG. 2, as long as the video pattern recognition system 14 does not detect an EAS tag (step S106), the video sensor 18 continues to capture video information (step S102). If the video pattern recognition system 14 detects an EAS tag (step S106), information determined by a parameter estimator 20, such as location, orientation, and/or velocity of the EAS tag is used to determine the orientation of the deactivation field and the timing for firing the deactivation sequence (step S108). The EAS tag is deactivated using the information determined by the parameter estimator 20 (step S110).

Embodiments of the present invention include several advantages. For example, the cost of video sensors is quite low due to their use in low-cost optical applications such as webcams, cell phones etc. Also, the cost of video digital signal processing ("DSP") chip sets used for video pattern recognition applications has dramatically decreased in recent years. This creates an opportunity for a significantly lower cost deactivation triggering technique.

Additionally, the use of video pattern recognition allows for more precise control over the timing of the deactivation triggering sequence and orientation of the deactivation field resulting in far less failures to deactivate and decreasing the number of "false alarms" for the EAS system when legitimate customers exit stores with purchased items that have not been properly deactivated. This approach may also dramatically improve the deactivation range by providing better control over the timing of the deactivation triggering and orientation of the deactivation field. The combination of traditional EAS detection technology and video based pattern recognition detection provides a dramatically improved ability to determine the optimal timing of the deactivation triggering and the orientation of the deactivation field.

Furthermore, embodiments of the present invention save energy as the deactivation system either does not produce the magnetic interrogation field at all, or is able to produce a significantly smaller field due to the added detection capabilities of the video pattern recognition system. Therefore, the size of components, such as energy storage capacitors and power supplies, needed for the deactivation circuit is significantly reduced.

The present invention can be realized in hardware, software, or a combination of hardware and software. Any kind of computing system, or other apparatus adapted for carrying out the methods described herein, is suited to perform the functions described herein.

A typical combination of hardware and software could be a specialized or general purpose computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A method for detecting the presence of an electronic article surveillance tag within a deactivation zone, the method comprising:

capturing video of an item within the deactivation zone;

evaluating the video using a pattern recognition technique to determine the presence of an electronic article surveillance tag within the deactivation zone; and deactivating the electronic article surveillance tag.

2. The method of claim 1, further comprising using the pattern recognition technique to determine at least one of location, orientation and velocity information for the electronic article surveillance tag.

3. The method of claim 2, further comprising using the at least one of location, orientation and velocity information for the electronic article surveillance tag to determine timing of a deactivation sequence.

4. The method of claim 2, further comprising determining an orientation of a deactivation field to deactivate the electronic article surveillance tag using the at least one of location, orientation and velocity information for the electronic article surveillance tag.

5. The method of claim 1, wherein the presence of the electronic article surveillance tag is determined by using the pattern recognition technique to identify at least one of a barcode and a marker denoting orientation of the electronic article surveillance tag.

6. The method of claim 5, wherein the electronic article surveillance tag is located within a predetermined distance from the at least one of a barcode and a marker denoting orientation of the electronic article surveillance tag.

7. The method of claim 5, wherein the marker denoting orientation of the electronic article surveillance tag is comprised of ultraviolet ink.

8. The method of claim 1, further comprising:

exposing the electronic article surveillance tag to a magnetic field to detect a frequency response signal from the electronic article surveillance tag; and using the pattern recognition technique in combination with the detected frequency response signal to determine at least one of location, orientation and velocity information for the electronic article surveillance tag.

9. An electronic article surveillance tag deactivator comprising:

a deactivation zone;

a video sensor operating to capture video of an item within the deactivation zone;

a video pattern recognition system communicatively coupled to the video sensor, the video pattern recognition system operating to evaluate the video using a pattern recognition technique to determine the presence of an electronic article surveillance tag within the deactivation zone; and a system controller communicatively coupled to the video pattern recognition system, the system controller operating to trigger deactivation of the electronic article surveillance tag in response to determining that the electronic article surveillance tag is within the deactivation zone.

10. The electronic article surveillance tag deactivator of claim 9, further comprising a deactivation trigger communicatively coupled to the system controller, the deactivation trigger operating to deactivate the electronic article surveillance tag.

11. The electronic article surveillance tag deactivator of claim 9, wherein the video pattern recognition system further operates to use the pattern recognition technique to determine at least one of location, orientation and velocity information for the electronic article surveillance tag.

12. The electronic article surveillance tag deactivator of claim 11, wherein the system controller further operates to use the at least one of location, orientation and velocity information for the electronic article surveillance tag to determine timing of a deactivation sequence.

13. The electronic article surveillance tag deactivator of claim 11, wherein the system controller further operates to determine an orientation of a deactivation field using the at least one of location, orientation and velocity information for the electronic article surveillance tag.

14. The electronic article surveillance tag deactivator of claim 9, wherein the video pattern recognition system determines the presence of the electronic article surveillance tag by using the pattern recognition technique to identify at least one of a barcode and a marker denoting orientation of the electronic article surveillance tag.

15. The electronic article surveillance tag deactivator of claim 14, wherein the electronic article surveillance tag is located within a predetermined distance from the at least one of a barcode and a marker denoting orientation of the electronic article surveillance tag.

16. The electronic article surveillance tag deactivator of claim 14, wherein the marker denoting orientation of the electronic article surveillance tag is comprised of ultraviolet ink.

17. The electronic article surveillance tag deactivator of claim 16, further comprising an ultraviolet light source communicatively coupled to the system controller, the ultraviolet light source operating to expose the electronic article surveillance tag to ultraviolet light.

18. The electronic article surveillance tag deactivator of claim 9, further comprising:

a electronic article surveillance tag detector communicatively coupled to the system controller, electronic article surveillance tag detector operating to expose the electronic article surveillance tag to a magnetic field to detect a frequency response signal from the electronic article surveillance tag; and wherein the system controller further operates to use the pattern recognition technique in combination with the detected frequency response signal to determine at least one of location, orientation and velocity information for the electronic article surveillance tag.

19. An electronic article surveillance deactivation system comprising:

an electronic article surveillance tag deactivator having:

a deactivation zone;

a video sensor operating to capture video of an item within the deactivation zone;

a video pattern recognition system communicatively coupled to the video sensor, the video pattern recognition system operating to use a pattern recognition technique to determine the presence of an electronic article surveillance tag within the deactivation zone;

a system controller communicatively coupled to the video pattern recognition system, the system controller operating to trigger deactivation of the electronic article surveillance tag in response to determining that the electronic article surveillance tag is within the deactivation zone; and a deactivation trigger communicatively coupled to the system controller, the deactivation trigger operating to deactivate the electronic article surveillance tag.

20. The electronic article surveillance tag deactivator of claim 19, wherein the video pattern recognition system further operates to:

use the pattern recognition technique to determine at least one of location, orientation and velocity information for the electronic article surveillance tag; and determine at least one of timing of a deactivation sequence and an orientation of a deactivation field using the at least one of location, orientation and velocity information for the electronic article surveillance tag.

* * * * *